US006905285B2

(12) United States Patent
Little et al.

(10) Patent No.: US 6,905,285 B2
(45) Date of Patent: Jun. 14, 2005

(54) SLOT DRAIN

(75) Inventors: Colin George Little, Dover (GB); Simon Francis Godwin Bradbeer, Ashford (GB)

(73) Assignee: Alumasc Limited, Dover (GB)

( * ) Notice: Subject to any disclaimer, the term of this patent is extended or adjusted under 35 U.S.C. 154(b) by 0 days.

(21) Appl. No.: 10/424,148

(22) Filed: Apr. 28, 2003

(65) Prior Publication Data

US 2003/0228193 A1 Dec. 11, 2003

(30) Foreign Application Priority Data

Apr. 29, 2000 (GB) ..... 0209755

(51) Int. Cl.[7] ..... E01C 11/22

(52) U.S. Cl. ..... 405/36; 405/118; 404/2; 404/4

(58) Field of Search ..... 404/2, 4; 405/118, 405/119, 121, 36, 39, 40, 41

(56) References Cited

U.S. PATENT DOCUMENTS 1,700,889 A * 2/1929 Heltzel ..... 249/4
3,815,213 A * 6/1974 Evans et al. ..... 29/446
5,538,361 A * 7/1996 Beamer ..... 405/118
5,564,857 A 10/1996 Schluter
5,971,662 A * 10/1999 Becker et al. ..... 405/119

FOREIGN PATENT DOCUMENTS

| | | | |
|---|---|---|---|
| EP | 0 167 384 A2 | | 1/1986 |
| WO | 0167384 | * | 1/1986 |
| WO | 0893545 | * | 10/1999 |

OTHER PUBLICATIONS

"Bauelemente Der Feinmechanik," Richter et al., *Bauelemente Der Feinmechanik*, 1959, pp. 151–156.

* cited by examiner

*Primary Examiner*—Sunil Singh
(74) *Attorney, Agent, or Firm*—Arent Fox PLLC

(57) ABSTRACT

A slot drain including a throat portion having two walls and a separator arranged to separate the two walls. The separator includes lateral projections passing through holes in the two walls. The lateral projections are bent over the two walls to retain the two walls against the separator as well as to maintain the separator in position.

30 Claims, 8 Drawing Sheets

SLOT DRAIN

BACKGROUND OF THE INVENTION

The present invention relates to drainage systems. More particularly, the present invention relates to slot drains or line drains, which facilitate high capacity drainage of surface water or other liquid through a narrow linear slot, while ensuring a high drainage capacity.

Slot drains generally consist of cylindrical pipes or channels embedded beneath the surface to be drained with relatively narrow slots or throats extending upwardly from the pipe to the surface. Water present on the surface to be drained enters the throat through the opening in the surface and falls into the pipe or channel via which it is carried away to an appropriate drainage outlet, possibly via a silt box. The main advantage of slot drains is that, although the area of the drainage opening on the surface is small, the conduit along which the water is carried to the drainage outlet is large. This means that the drainage system can cope with heavy rainfall without requiring an excessive area of opening to be present. This is extremely important in some situations such as, for example, on roads and runways where surface water can be hazardous but where large drainage openings would be equally hazardous.

GB 2 311 549 discloses a slot drain in which the throat and channel are made from two pieces of steel, which are joined at the region of the base of the channel, each piece of sheet pressed steel forming one side of the channel and one wall of the throat. The hydraulic slot between the throat walls is formed by a series of spacer plates or separators that are welded to the throat walls and can extend the full depth of the throat. Restricted access tends to make the welding operating both tedious and time consuming. The separators are welded to the walls of the throat before the slot drain is galvanised and before being transported to the site at which the slot drain is to be used.

It is an object of the present invention to overcome or ameliorate at least one of the disadvantages of the prior art.

THE INVENTION

According to the invention, there is provided a slot drain including a throat portion with two opposed side walls. At least one of the side walls has a hoe therein. The slot drain also includes a separator arranged to separate the side walls by abutment of the walls against opposite sides of the separator. The separator has a lateral projection which passes through the hole and is deformed so it cannot pass back through the hole without further deformation. The respective wall being retained against or adjacent to the separator. A kit of parts is provided for the slot drain. A method of constructing a slot drain includes the steps of passing the lateral projection of the separator through the hole; and retaining the respective wall against or adjacent the separator by deformation of the lateral projection so the lateral projection cannot pass back through the hole without further deformation. A drainage system includes a plurality of slot drains connected end to end. A road or runway includes a drainage system having a plurality of slot drains connected end to end.

An advantage of the invention is that the lateral projection of the separator retains the throat side walls from the outside of the throat portion. This allows simple construction and assembly of the slot drain and reduces assembly time. The throat side walls can be fixed to the separators without any specialist tools and without precision workmanship, as the lateral projection on the separator can be mechanically deformed by hand or using a simple mechanical tool. It is not necessary to weld the separator to the inside walls of the throat portion. Thus no sophisticated techniques are required for assembly, and the disassembled slot drains can be assembled anywhere in the world.

Preferably, the lateral projection comprises a projecting portion projecting away from the separator in the plane of the separator and a retaining portion parallel to the side of the separator. This provides the lateral projection with a retaining portion which can be deformed either by hand or with the aid of a simple mechanical tool in order to stop the lateral projection from passing back through the hole in the wall. Preferably, the lateral projection is bent about an axis perpendicular to the plane of the wall adjacent the lateral projection. If there is a said retaining portion, the retaining portion is deformed so that it abuts the wall of the throat portion.

Alternatively, the deformation may be bent about an axis parallel to the plane of the wall adjacent the lateral projection. In this case, the lateral projection may be bent over towards the wall, either manually or with a simple tool, e.g. a hammer, in order to retain the wall within a predetermined range of separations.

As a further alternative, the separator may be arranged to retain the walls by receiving a separate retaining member. This may be achieved by the lateral projection comprising a hole and the retaining member comprising a pin passing through the hole in the lateral projection and abutting the outer surface of the wall adjacent the lateral projection. An advantage of this is that no deformation of the lateral projection is required. The pin may be removable to facilitate disassembly of the throat portion, or may be welded in place.

Preferably, the separator comprises a plurality of projections. This provides increased securing of the separator to the walls of the throat portion.

Each wall may comprise a plurality of holes. This allow a lateral projection to pass through each hole, or allows adjustability of the separators to allow adjustability of the separation of the throat portion. However, preferably, the respective throat wall has a single hole for each separator.

Preferably, an upper projection and a lower projection are provided on a side of the separator, the upper projection providing an upper shoulder against which the upper edge of the respective hole abuts and the lower projection providing a lower shoulder against which the lower edge of the respective hole abuts, in order to locate the separator vertically with respect to the respective throat wall, whether there is one hole or two separate holes.

Preferably,.the separator is a flat piece. This allows drainage water to flow freely down the throat portion. Preferably, the lateral projection is integral with the separator. This provides extra strength to the separator.

Preferably, each wall has at least one hole. This allows a lateral projection to pass through each wall in order to retain the walls within a predetermined range of separations.

Normally, a plurality of separators would be used, spaced along the throat. This provides extra rigidity to the throat portion.

Preferably the slot drain also includes a hole adjacent an end of the drain and the lateral projection can be bent so as to project beyond the end of the drain and be adjacent to or touching the throat wall to provide horizontal registration with the end portion of a second drain slot.

Preferably, at least one of the separators comprises means for handling the slot drain. When the separator is in position, the slot drain can be handled using the means for handling, so easing positioning of the slot drain. To provide the handling means, the separator can have a lateral handling projection on each side, projecting out through respective holes in the throat walls, and handling holes can be provided in the handling projections. For handling, bars can be inserted in the handling holes so that the bars extend parallel to the slot drain. The bars can be used to lower the slot drain into a trench. Preferably the handling projections are separate from the lateral retaining projections though it may be convenient to arrange for the handling projection to pass through the same hole in the throat wall as a retaining projection.

Preferably, at least one of the separators comprises means for securing the slot drain in position when installed. To provide the securing means, the separator can have a lateral securing projection and e.g. a hook can be provided by or on the securing projection, for attaching to an external securing member such as a reinforcement rod or reinforcement mesh. The external securing member may be set in concrete, so providing the slot drain with stability against sideways movement. The handling projection can also form the securing projection.

Preferably, the drain is formed from two parts and further comprises a channel portion arranged to carry drainage water through the drain, the two parts being joined at the base of the channel portion. This means that the two parts may be substantially symmetrical, and substantially identical. As the parts can be made of sheet material, the parts can be nested. Thus in addition to the parts being of lighter weight, being formed of sheet material, and thus easier to handle, they can be stacked in nested form for transport, warehousing and on site, taking up less space and reducing the dangers of unstable stacking. In particular, this can greatly reduce transport and warehousing costs.

Preferably, a mounting member is provided for mounting the slot drain, the mounting member being connected to the channel. Preferably the mounting member is connected to opposite sides of the channel, and preferably comprises two substantially parallel vertical portions for securing to the channel, the mounting portions being connected by a transverse portion. The transverse portion provides a foot upon which the slot drain may be stood during assembly and fixing in position. The transverse portion may be set in concrete before the rest of the slot drain is covered.

Preferably, the transverse portion has a plate connected to it to aid retention in the concrete. Preferably, the plate is at least twice the width of the transverse portion.

A collar may be fixed to the mounting member, for joining a second slot drain to the first-mentioned slot drain. If the collar is generally of a U-shape, it provides a simple cradle type joining of two slot drains, the second slot drain resting on the collar so that the sides of the channel are aligned. If the channel portion has a downwardly projecting flange, the U-shape can have a gap at the bottom to accommodate the flange. Preferably, the collar is arranged to be connected to the mounting member in the plane of the sides of the channel of the slot drains. This aids alignment of the two slot drains.

Alternatively or in addition, the mounting member may comprise a projecting portion arranged to engage with a second mounting member on a second slot drain. In this alternative, the mounting members provide the alignment between two slot drains. The projecting portion may be arranged to rest on the top of the second mounting member, to provide vertical alignment. The slot drain may have a mounting member with a projecting portion at each end, for cooperating with slot drains having mounting members with no projecting portions. Alternatively, the slot drain may have a mounting member with a projecting portion at one end and a mounting member with no projecting portion at the other end.

The slot drain may be formed into a line drainage system comprising a plurality of slot drains. The slot drain can be used in a multitude of applications where surface water drainage is required including roads, airport taxiways and aprons, car parks, warehouses, in fact any hard standing area.

As indicated above, the slot drain can be made of two sheet-like parts, suitably profiled. Preferably, the slot drain and/or the separator(s) are made from galvanised or coated steel sheet.

EMBODIMENTS OF THE INVENTION

Embodiments of the invention will now be described, purely by way of example, with reference to the accompanying drawings, in which.

FIGS. 1 to 6 and 13—A FIRST SLOT DRAIN AND A MODIFICATION

Figure 1:
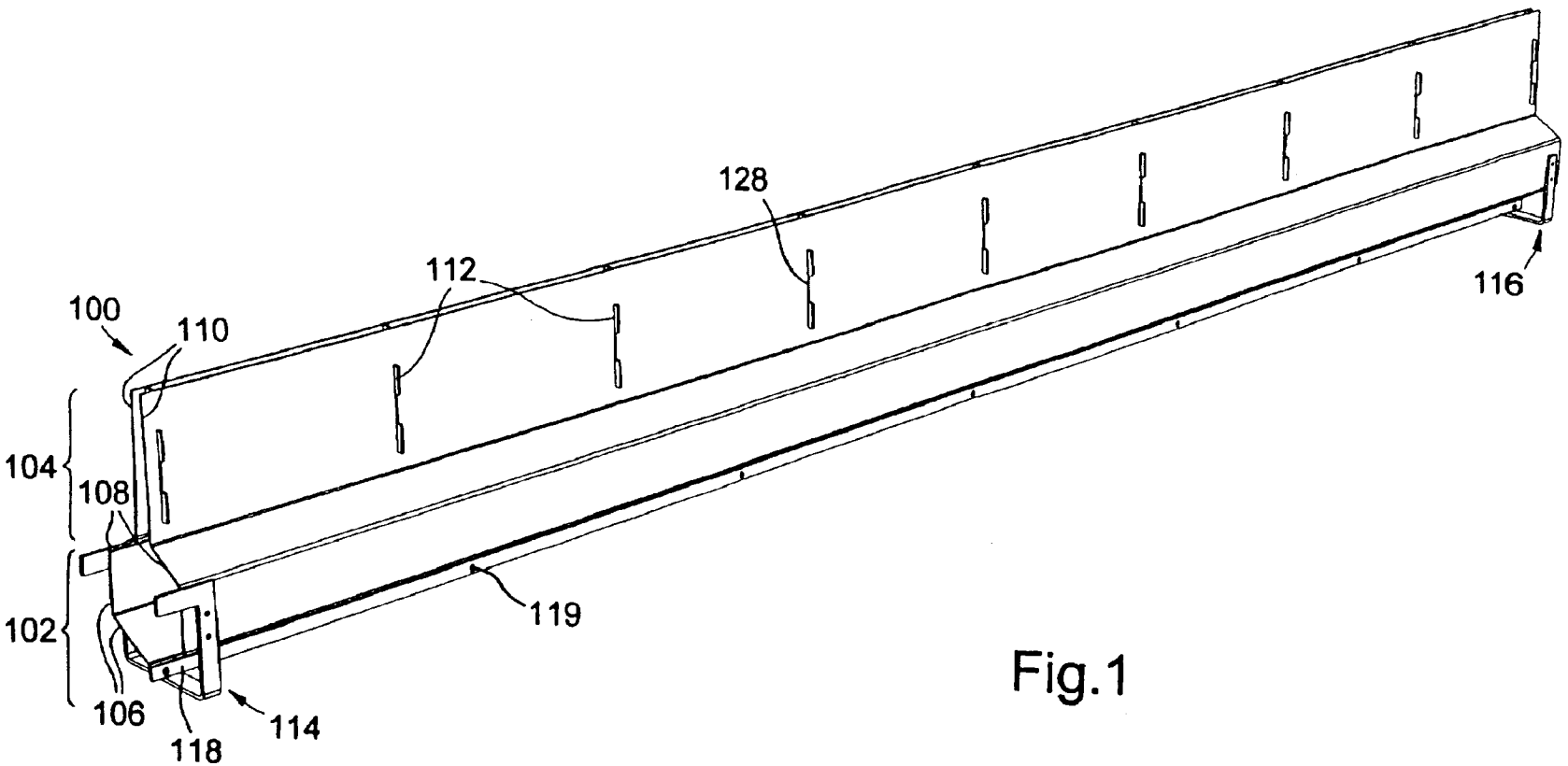
FIG. 1 shows a perspective view of a first slot drain according to the present invention, before bending the retaining projections into position.
Figure 2:
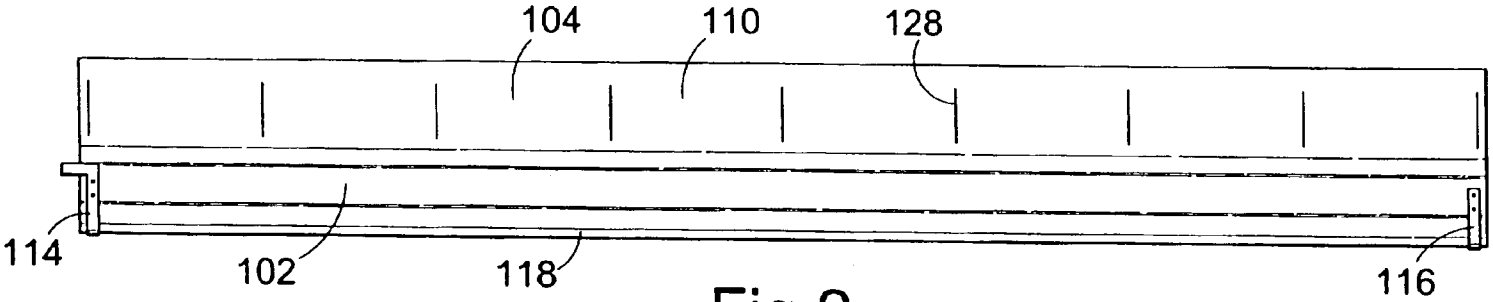
FIG. 2 shows a side view of the slot drain of FIG. 1.
Figure 3:
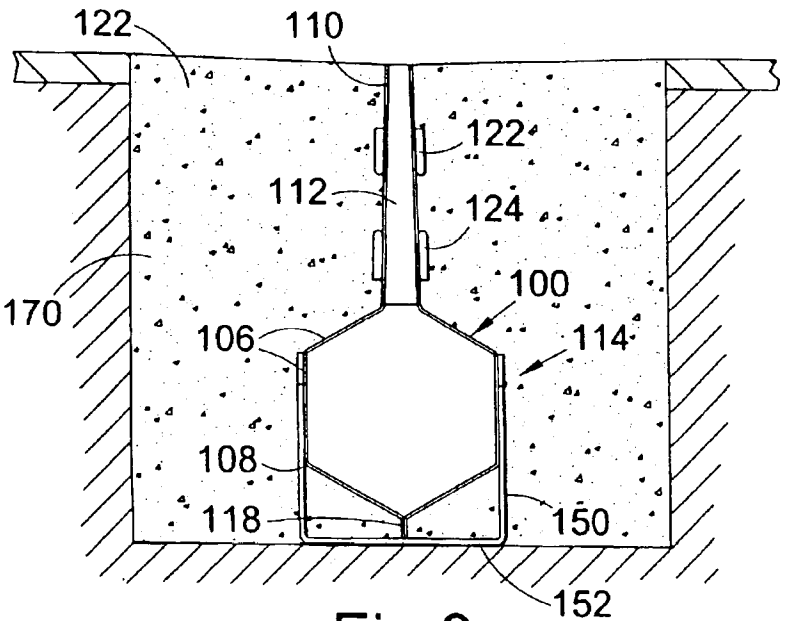
FIG. 3 shows an end view of the slot drain of FIG. 1, installed in position.

FIGS. 1, 2 and 3 show a slot drain 100 comprising a channel portion 102 and throat portion 104. The channel portion 102 is substantially hexagonal in shape with the throat portion 104 extending substantially vertically up from the channel portion 102.

The channel portion 102 has six planar sides 106 of substantially equal length. Sides 106 meets at corners 108. One of the corners 108 is arranged to be located at the lowermost point of the slot drain 100, substantially diametrically opposite throat portion 104. The channel portion 102 may be about 300 mm wide.

Throat portion 104 consists of two upwardly extending side walls 110. The walls 110 converge slightly away from the channel portion 102, so as to form a slightly flared throat, preventing debris from becoming permanently lodged and blocking the opening. The throat opening width may be varied to facilitate variance in the intake capacity of the slot drain. The angle of convergence may be about 4.5°. The slot may be about 30 mm wide.

Inside the throat portion 104 are vertically extending spacer plates or separators 112 (see FIG. 3). The separators 112 are transverse to the walls 110, and extend substantially the whole height of the throat between the top and the junction with the channel portion 102. Alternatively, the separators 112 may be shorter in length, for example extending only half of the height of the throat portion 104. The separators 112 provide strength and stability to the throat portion 104 to ensure separation of the walls 110 so that the walls 110 do not bow or collapse towards each other.

At one end of the slot drain there is provided a first mounting bracket 114. The mounting bracket is attached to the channel portion 102 on each of its two vertically extending sides 106. At the other end of the slot drain a second mounting bracket 116 is attached to the vertical sides 106 of the channel portion 102.

The slot drain 100 is formed from two identical parts or halves of e.g. 3 mm galvanised sheet steel. Each half is pressed into shape and comprises one of the walls 110 of the throat portion, together with three of the sides 106 of the channel portion 102. A flange 118 is provided along the lower side of the half. Prior to assembly, the halves can be nested, with other such halves. In order to assemble, the two halves forming the channel 102 and throat 104 are brought together with the separators 112 between the walls 110. The two pressed halves are fixed together where the flanges 118 meet. The flanges 118 will be parallel when placed together and are mechanically fixed together using e.g. rivets 119 through the flanges 118, to provide a join at the bottom corner 108 of the channel 102. A sealing material or mastic can be introduced between abutting flanges 118 effect a leak tight joint. The sealing material may be a suitable mastic, a suitable tape, for example "DENSO" (RTM), or a suitable rubber seal. The side walls 110 are fixed to the separators 112 as described below.

Instead of galvanised steel, the halves could be made from any material suitable for this application, e.g. plastic/GRP/polymer concrete.

Figure 4:
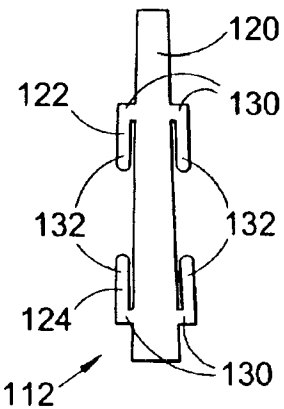
FIG. 4 shows a separator in the slot drain of FIG. 1.

FIG. 4 shows a separator 112. The separator comprises a body 120, the sides of which converge towards the top at the same angle as the wall 110 of the throat portion 104. The body 120 is flat and has upper and lower lateral retaining projections 122, 124 on each side.

The walls 110 have holes or slits 128 cut in them. The holes 128 are generally rectangular in shape, the dimensions corresponding to the thickness of the lateral projections 122, 124 and the distance between the top of the upper lateral projection 122 and the bottom of the lower lateral projection 124. The holes 128 in the walls 110 are e.g. laser cut to provide accurate location for the lateral projections 122, 124 to pass through the walls 110.

The lateral projections 122, 124 pass through the holes 128 in the walls 110. Each lateral projection 122, 124 is L-shaped, being formed of a projecting portion 130 projecting perpendicularly away from the body 120 in the plane of the body, and a retaining arm 132 parallel to the side of the body 120. The arm 132 of the upper lateral projection 122 extends downwardly, while the arm 132 of the lower lateral projection 124 extends upwardly. This is so that the projecting portions 130 locate on the upper and lower edges of the slit or hole 128, providing positive vertical location of the separator 112 with respect to the wall 110. The gap between the side of the body 120 and the inside of the retaining arm 132 is sufficient for the arm 132 to pass through the hole 128 and be bent so that the inside of the arm 132 abuts the external surface of the wall 110, while the side of the body 120 abuts the internal surface of the wall 110. The gap need not be exactly the same as the width of the wall 110. Some play may be introduced. The separators 112, and therefore the walls 110, are fixed in place because the retaining arms 132, once deflected, cannot pass back through the holes 128 without further deflection.

Because the slot drain is not welded, it can be assembled on site. A conventional, welded slot drain cannot be assembled on site because the galvanising step must occur after the welding step. If the welding is carried out on galvanised steel then poisonous fumes are produced.

Figure 5:
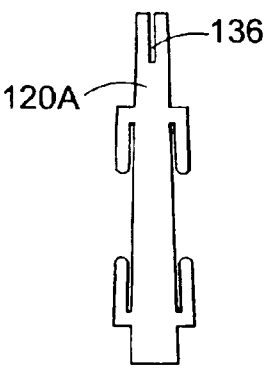
FIG. 5 shows an alternative separator according to the present invention.
Figure 13:
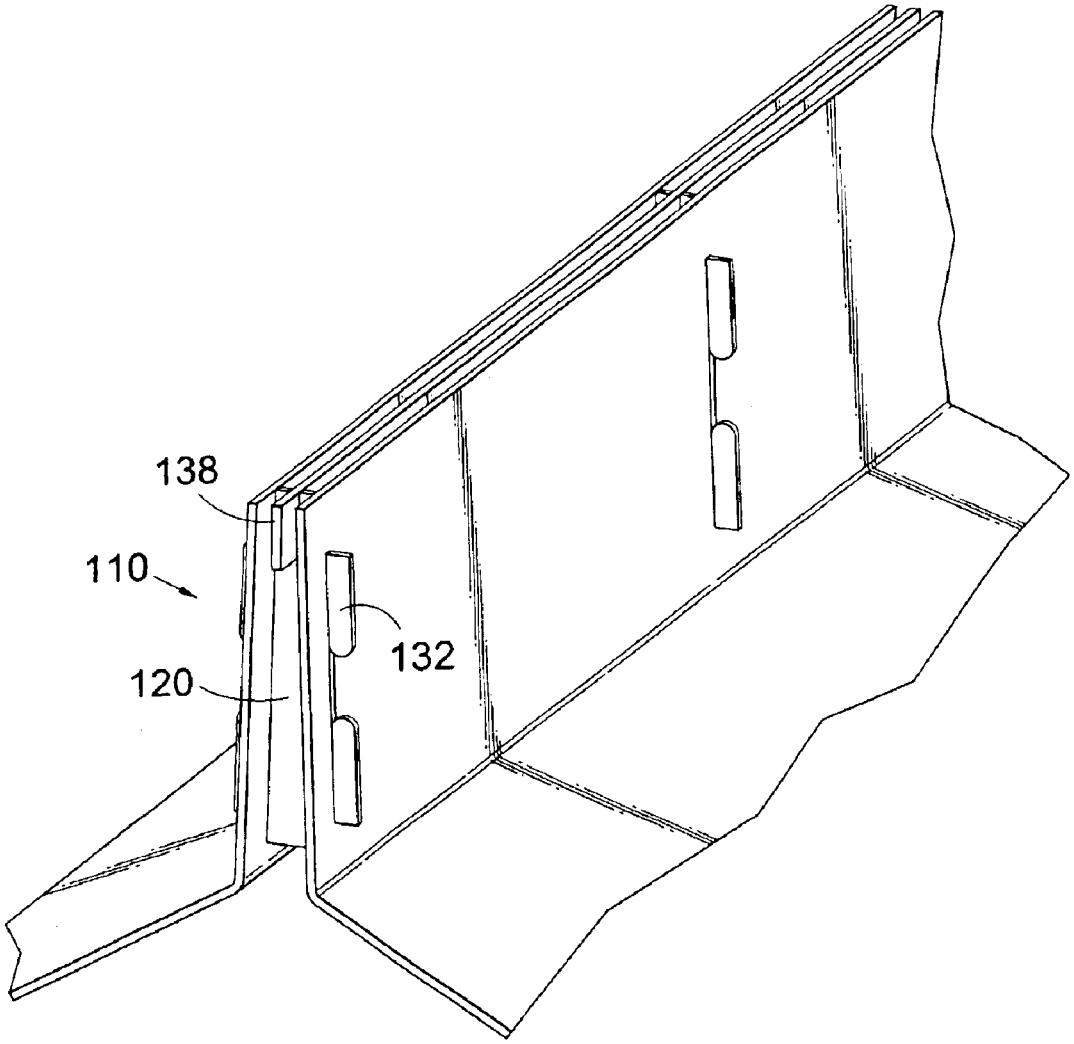
FIG. 13 shows a detail of a slot drain according to the present invention incorporating the separator of FIG. 5.

FIGS. 5 and 13 show an alternative form for the separator 112. The separator body 120A comprises a slot 136. The slot 136 accommodates a steel plate 138. The steel plate 138 extends substantially the whole height of the slot 136 and is perpendicular to the plane of the body 120A.

As shown in FIG. 13, the steel plate 138 divides the throat in two longitudinally, providing a central support for objects resting on the top of the throat portion 104, above the slot drain. The steel plate 138 also reduces the size of the minimum dimension of an object which can pass into the throat portion 104, such as the heel of a shoe. The steel plate 138 is held in place in the slot 136 by compressive force from the sides of the slot 136 caused by force of the walls 110 on the separator 112.

The slot 136 is laser cut for precision. In one embodiment, the slot 136 is 25 mm high and 3 mm wide.

Figures 6, 7:
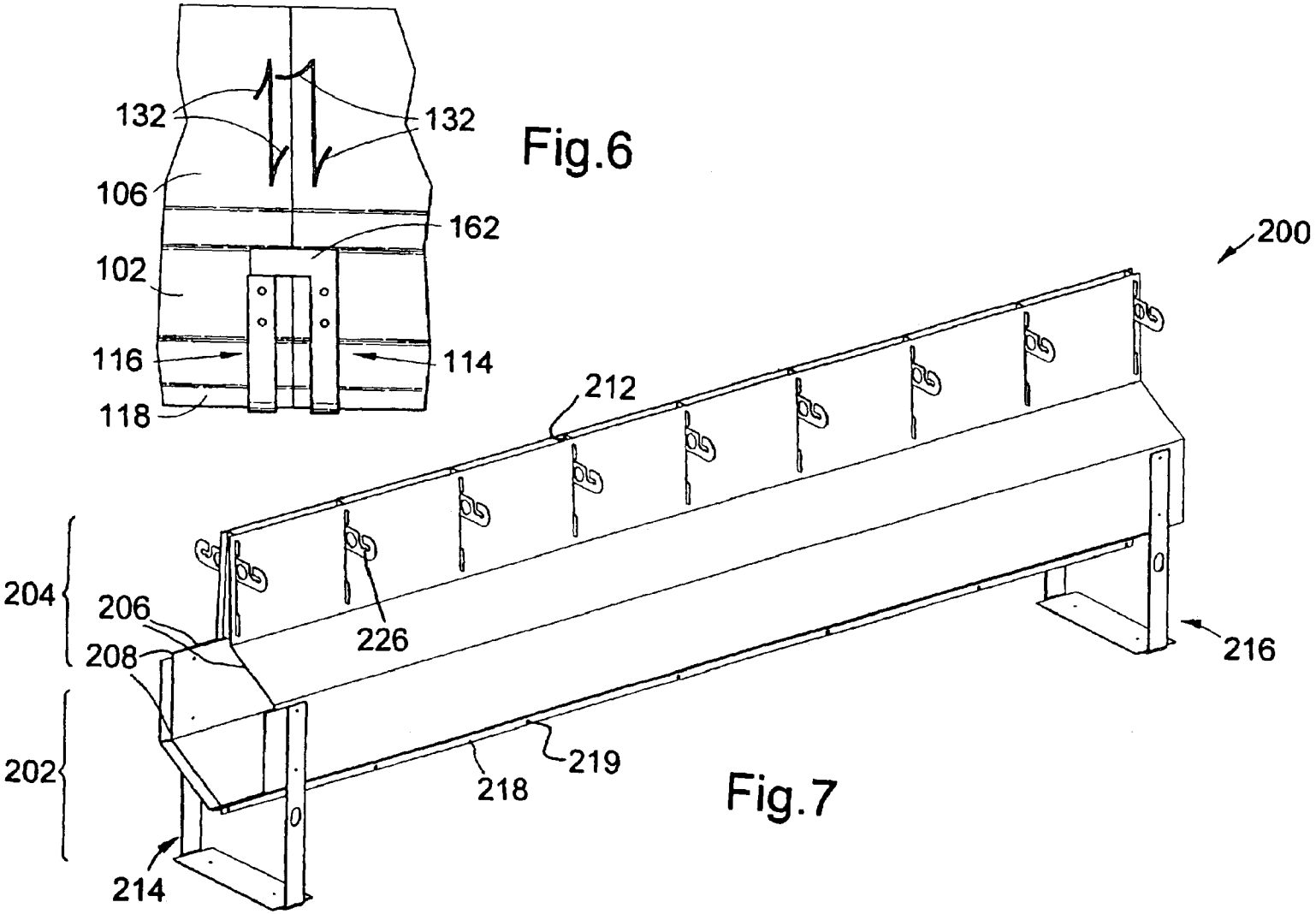
FIG. 6 shows a side view of an end of the slot drain of FIG. 1, showing the end of another such slot drain, the retaining projection being shown bent into position.
FIG. 7 shows a perspective view of a second slot drain according to the present invention.
Figure 8:
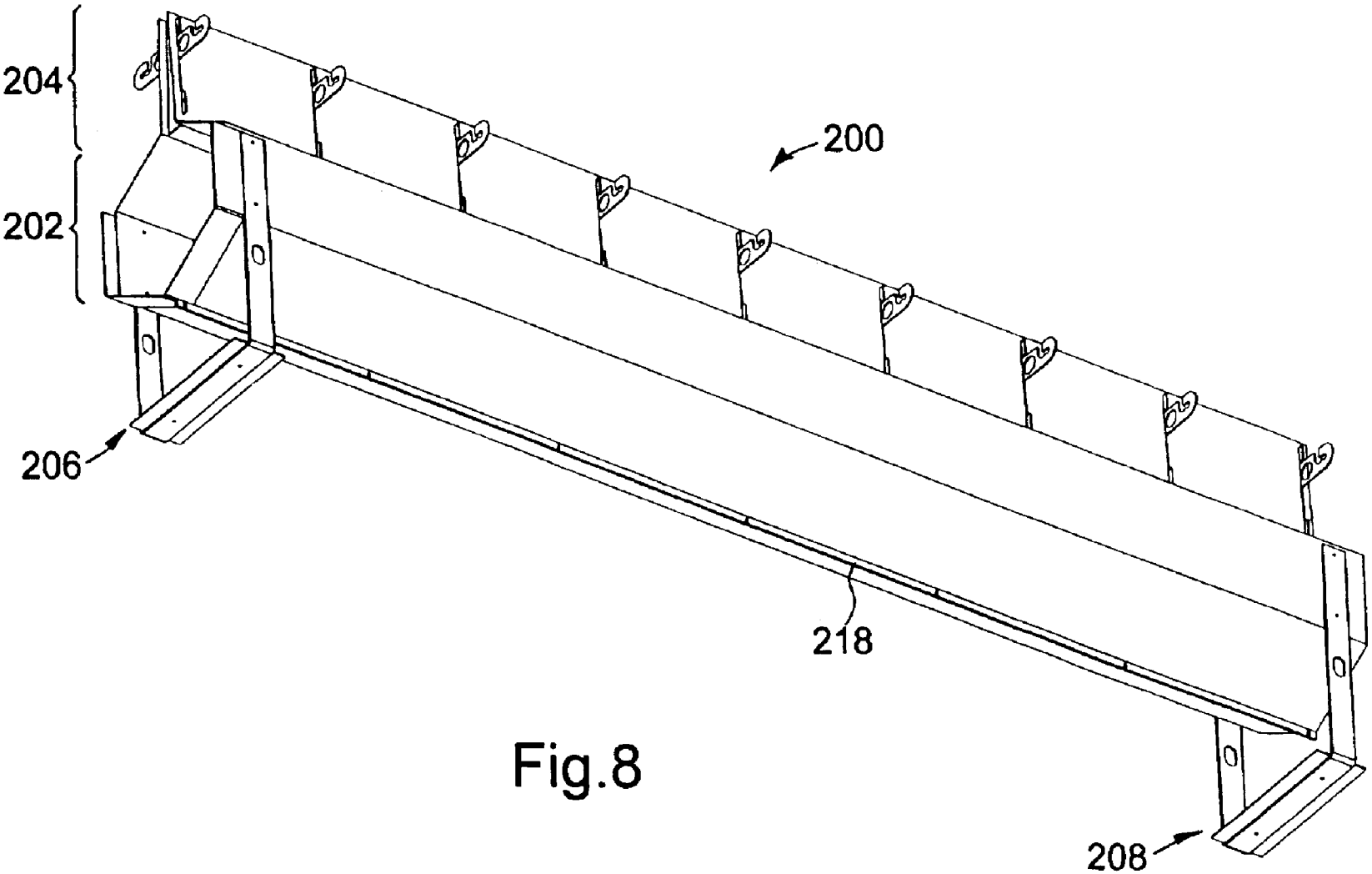
FIG. 8 shows a further perspective view of the slot drain of FIG. 7.

FIG. 6 shows the retaining arms 132 of the separator 112 once they have been passed through the holes 128 in the walls 110 and have been bent. All the retaining arms 132 are bent about an axis substantially perpendicular to the plane of the walls 110 (and with a suitable tool, both retaining arms 132 on one side of the separator 112 can be bent simultaneously). This ensures that the walls 110 cannot separate without bending back of the upper and lower lateral projections 122, 124. The retaining arm. 132 of the upper lateral projection 122 is bent to a greater extent than the other retaining arms 132 to provide a lateral location for the next channel. This occurs because the portions of the lateral projections 122 extending beyond the end of the throat portion 104 ensure that a throat portion of a second slot drain is held in register with the throat portion 104 of the first slot drain.

The separators 112 can be laser cut or punched from say 3 mm galvanised steel or any other suitable material.

FIGS. 3 and 6 show a first mounting bracket 114. The bracket 114 comprises two vertical members 150 connected at their lower ends by a transverse member 152. The separation of the vertical members 150 is equal to the distance between the vertical sides 106 of the channel portion 102, so that the vertical members 150 can be e.g. riveted to the vertical side 106 of the channel portion 102. The transverse member 152 abuts the flanges 118 at the base of the channel 102, providing extra structural support for the channel 102. The vertical members 150 of the first mounting bracket 114 have horizontal arms 162 projecting substantially parallel to the sides 106 of the channel 102. The arms 162 project from the top of the vertical members 150. The arms 162 project past the end of the channel 102.

FIGS. 3 and 6 show a second mounting bracket 116. The second mounting bracket 116 is the same as the first mounting bracket 114 except that there are no horizontal arms 162 extending from the vertical members 150. Instead, the vertical members 150 extend upwardly only as far as height corresponding to the lower edge of the arm 162 of the first mounting bracket 114. This gives the effect that when the mounting brackets 114, 116 are attached to the channel 102, two channels can be joined accurately with a first mounting bracket 114 engaging a second mounting bracket 116. The arm 162 of the first mounting bracket 114 extends to and rests upon the top of the second mounting bracket 116, when two slot drains are brought together. This means that the ends of all the channel sides on one slot drain register with the corresponding ends of the other slot drains, so that they can easily and effectively be joined.

As shown in FIG. 3, the slot drains 100 can be lowered into a trench which is then back-filled with concrete 170 to the height of the top of the slot drains 100. Some arrangement must be employed to prevent the drains 100 rising due to their buoyancy.

FIGS. 7 to 12—A Second Slot Drain

The second slot drain 200 is the same as the first slot drain 100, except that the separators and mounting brackets are altered and the throat portion 204 is less high.

Figure 9:
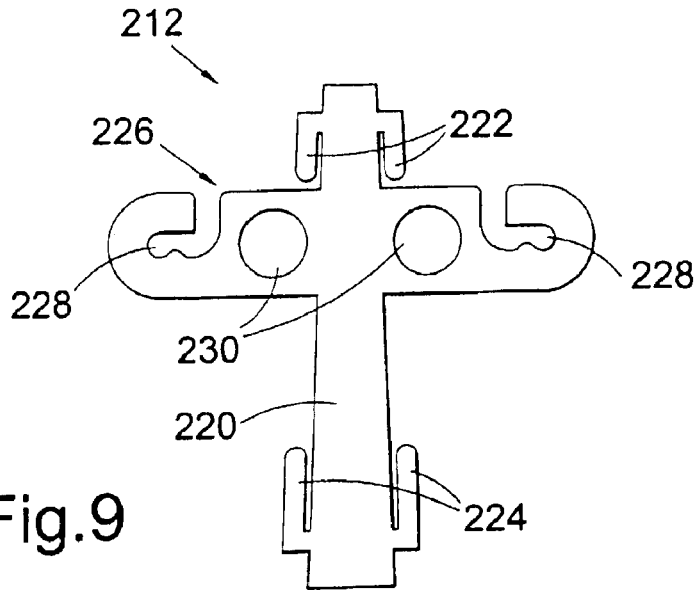
FIG. 9 shows a separator in the slot drain of FIG. 7.
Figure 10:
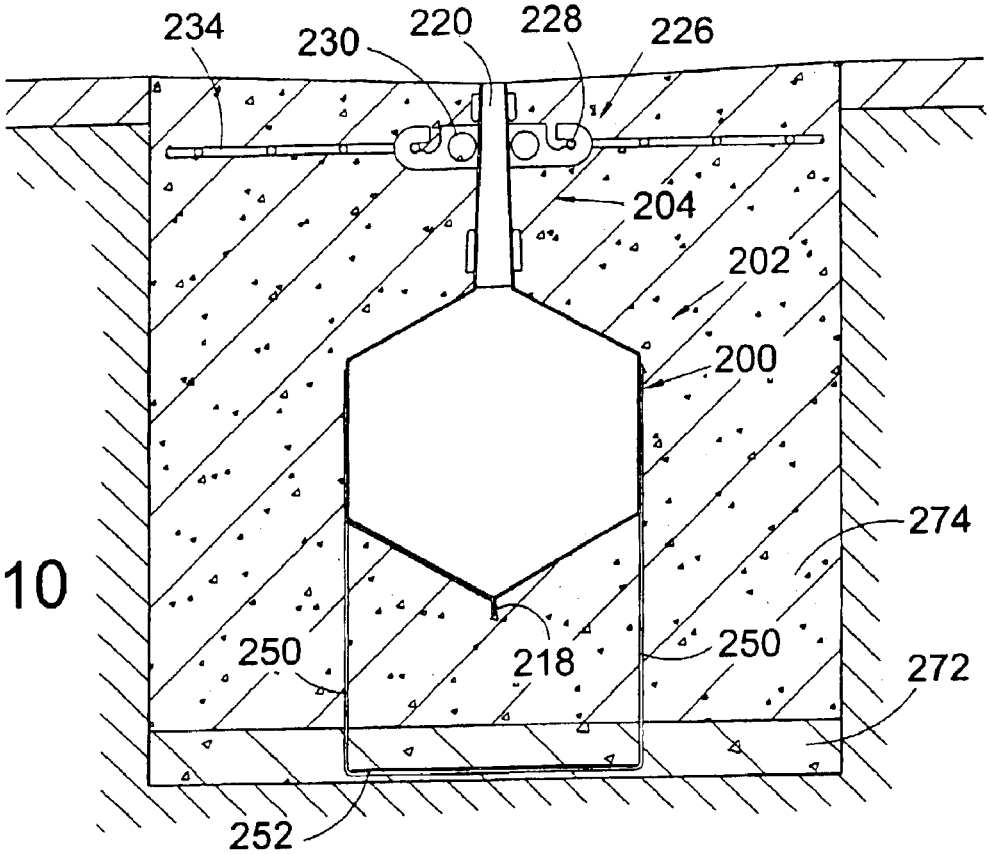
FIG. 10 shows an end view of the slot drain of FIG. 7, installed in position.

As shown in FIG. 9, the body 220 of the separator in the second slot drain 200 has a cross-member or lateral handling projection 226 which projects out on each side of the body 220 approximately one third of the way down the height of the body 220. The cross-member 226 has a securing member or hook 228 on either side of the cross-member 226, distal to the body. Between the hook 228 and the body, on each side of the cross-member 226, there is provided a mounting or handling hole 230, which can be used to lift and move the slot drain 200 into position. The upper and lower lateral retaining projections 222 and 224 are the same as in the first slot drain 100 and function in the same manner. The hooks 228 are attached to e.g. reinforcement mesh 234 (see FIG. 10), the mesh 234 being set in concrete to secure the slot drain 200 in position.

The separator of the second slot drain 200 may have a vertical slot (not shown) in the body 220, in the same manner as that shown in FIG. 5 with regard to the first slot drain 100. The purpose and arrangement of the slot are the same as for the first slot drain 100.

Figure 11:
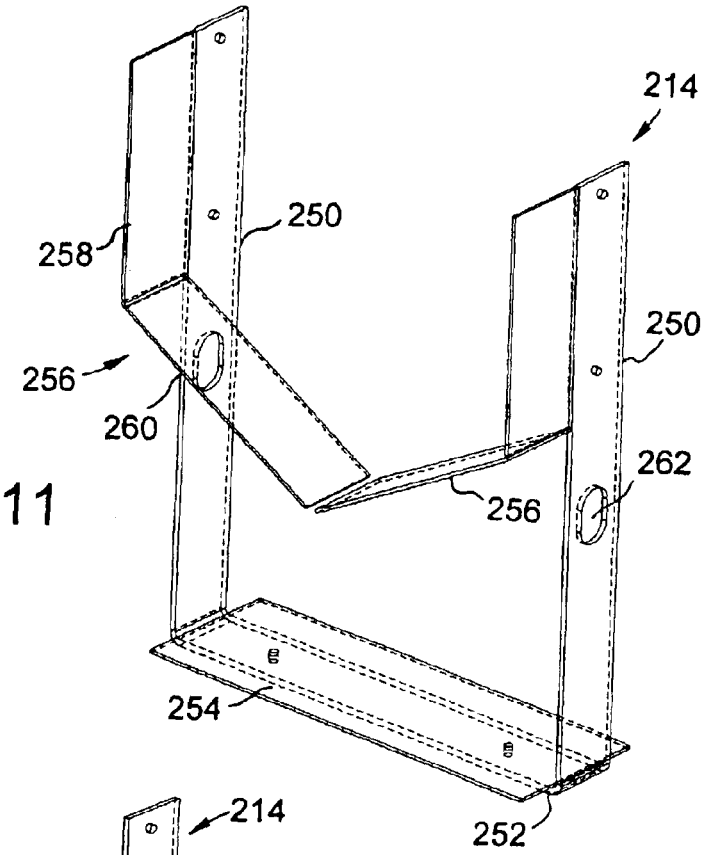
FIG. 11 shows a perspective view of a mounting bracket of the slot drain of FIG. 7.

FIG. 11 shows a detailed view of the first mounting bracket 214 of the second slot drain 200. As in the first embodiment, the bracket 214 comprises two vertical members 250 connected at their lower ends by a transverse member 252. The separation of the vertical members 250 is equal to the distance between the vertical sides 206 of the channel portion 202, so that the vertical members 250 can be connected to the vertical sides 206 of the channel portion 202.

The arrangement is such that a blinding layer of concrete 272 (FIG. 10) is filled into the bottom of the trench, before or after placing the slot drains 200 in position. When it has at least partially set, the remaining concrete 274 is poured and the blinding layer 272 prevents the slot drain 200 rising due to natural buoyancy. Attached to the transverse member 252 is a plate 254. The plate 254 increases the engagement with the blinding layer 272 while pouring the remaining concrete. The dimensions of this plate 254 should be calculated with respect to the size of the channel portion 202 being used and should minimise the stress in the blinding layer 272 to an acceptable figure with respect to the quality of concrete being used. In one embodiment for example, a channel with body width of 300 mm and a throat height of 300 mm should be provided with a plate of dimensions 455 mm×100 mm. The plate 254 may be attached to the transverse member 252 by rivets. Preferably, the vertical members 250 and transverse member 252 are made from one piece of steel. The plate is also preferably made from steel.

A collar 256 is connected to each of the vertical members e.g. by welding. Each of the collars 256 comprises a vertical portion 258 and an inwardly inclined portion 260, forming a generally U-shaped cradle. The inwardly inclined portion 260 is arranged so that it is parallel with one of the lower sides of the channel portion 202. A gap is left between the ends of the inwardly deflected portions 260 of the collars 256, through which the flanges 218 pass when the channel portion 202 is placed in the bracket. The slot drain 200 rests on the collars 256. The transverse member 252 is therefore separated from the bottom of the channel portion 202.

The vertical members 250 also comprise handling holes 262. These holes 262 allow attachment of the slot drain units 200 to a jig (not shown) on the surface of the trench via rods (not shown), which facilitates faster and easier installation.

This jig is attached at the collar 256 end of the slot drain 200 and has a lateral limiter. By varying the position of the lateral limiter and the length of rod between the holes 262 and the jig, the position of the slot drain 200 in the trench can be set before the blinding layer of concrete 272 is poured. The collar 256 provides positive location for an end of the next slot drain 200.

Figure 12:
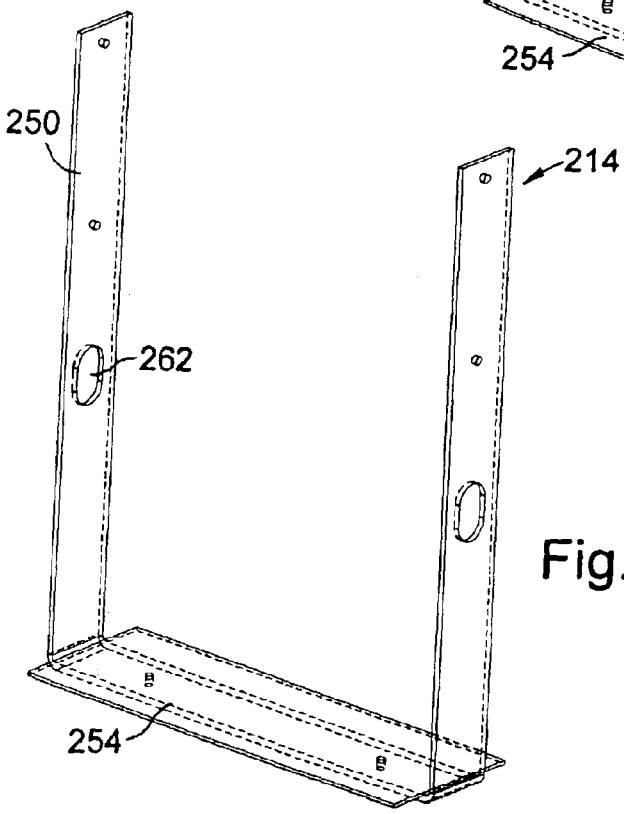
FIG. 12 shows a further perspective view of another mounting bracket of the slot drain of FIG. 7.

FIG. 12 shows the second mounting bracket 216. The second mounting bracket 216 is the same as the first mounting bracket 214, with the exception that the second mounting bracket 216 has no collars 256. The second mounting bracket 216 is connected to the channel portion 202 sufficiently far from the end of the channel portion 202 that a collar 256 from a first mounting bracket 214 attached to another slot drain 200 can engage with the sides 206 of the channel portion 202.

The transverse members 252 may be set in a concrete blinding layer 272 which is 7.5 cm deep and has a minimum grade of C20–C25. The trench is then filled with concrete 274 with the minimum quality grade of C40. A layer of pavement quality concrete is placed on the top of the trench. The cross member 226 is arranged such that its top is 7 cm below the surface, the opening of the throat portion 204 being level with the surface.

The lateral projections 122, 124 or 222, 224 need not be deformed about an axis perpendicular to the walls. They may instead be deformed about an axis substantially parallel to the walls, or about a combination of these axes. In fact, any deformation may be used, which need not include rotation at all, as long as the lateral projections cannot pass back through the holes in the walls without further deformation. For example, the lateral projections may be in the form of barbs or hooks.

The slot drain 100 or 200 can therefore be assembled without the need for any welding. In addition, the manner of assembly is very simple and is also fast when compared with the previous assembly methods. The assembly of the separators 112 or 212 may be completed without any specialist tools and without precision workmanship. The mechanical assembly of the throat and channel portions by riveting at the base of the channel, and the placement of the separators in the throat by deformation, facilitates on site manufacture, and can result in an eight fold increase in output when compared with the previous method. Transportation costs can be reduced by on site construction, as the parts can be stacked more densely or nested prior to assembly.

It should be appreciated that the channel portion may be another shape, other than hexagonal. These may include many types of polygon, regular or non-regular. Some or all of the sides can be arcuate, or the channel portion can be circular or ovoid. If there are no vertical sides to the channel portion, the sides of the mounting brackets can be angled to match any of those of the channel sides.

The separators 212 of the second slot drain 200 can be used without alteration in the first slot drain 100, and vice versa. Similarly, the mounting brackets 214 of the second slot drain 200 can be used in the first slot drain 100, and vice versa.

Figure 14:
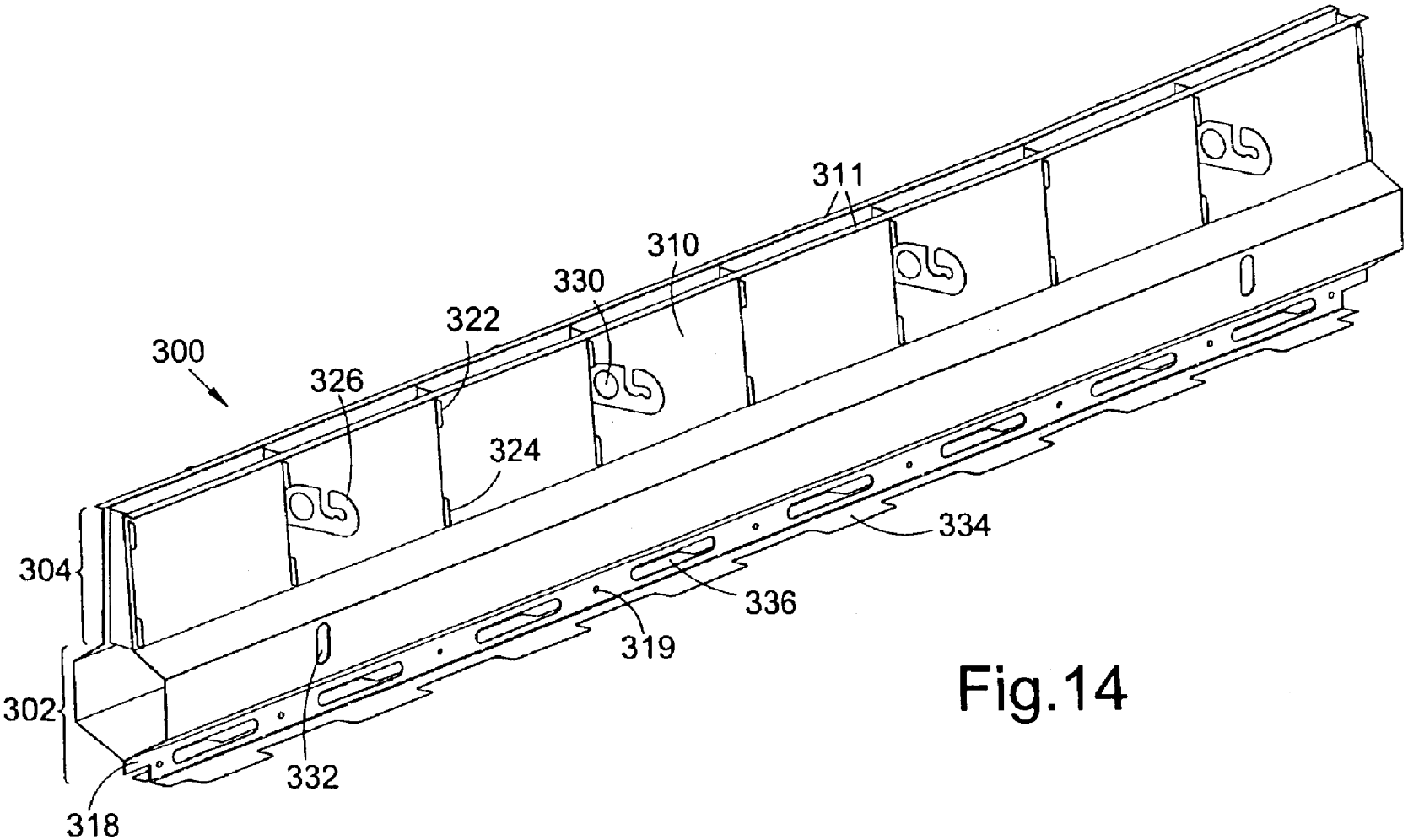
FIG. 14 shows a perspective view of a third slot drain according to the present invention.

FIG. 14—A Third Slot Drain

The slot drain 300 of FIG. 14 is in many respects the same as the slot drain of FIGS. 7 to 10, and the same references, with the addition of 100, are used as in FIGS. 7 to 10.

As the top of the throat portion 304, the side walls 310 are provided with horizontally-extending outwardly-turned lips 311.

In the channel portion 302, the side walls are provided with openings 332. These serve the purpose of enabling the slot drain to be suspended from the surface of a trench by placing transverse rods through the opening 332 and putting hooks on the transverse rods. As the channel side walls 310 are further apart than the holes 330 in the cross-members 326, this gives better stability than suspending the slot drain using the cross-members 326.

At the base of the channel 302, each vertical flange 318 has a horizontal flange 334 along its bottom so that the two horizontal flanges 334 project in opposite directions. The flanges 334 are for resting on a surface and supporting the slot drain 300, should this manner of installation be desired. The vertical flanges 318 are provided with openings 336 so that concrete can flow through from side to side and securely anchor the slot drain 300 in position in the bottom of a trench.

The openings 332, 336 can be formed in any suitable way, for instance by laser cutting.

For aligning the slot drains 300, a generally U-shaped cradle can be formed, in effect like the cradle shown in FIG. 11, made of the collars 256, by riveting pieces to one end of the lower half of the channel portion 302. This riveting can be done before the slot drain is assembled.

When using the slot drain of FIG. 14, after suspending from the surface as indicated above, the trench can be filled with concrete up to a level slightly below the openings 332, the concrete allowed to set, the horizontal bars removed, the openings 332 closed with builder's tape, and the rest of the concrete poured.

With suitable modification, the lips 311 and/or the openings 332 and/or the horizontal flanges 334 and/or the openings 336 can be applied to the first and second slot drains 100, 200 described above.

Any discussion of the prior art throughout the specification should in no way be considered as an admission that such prior art is widely known or forms part of common general knowledge in the field.

Unless the context clearly requires otherwise, throughout the description and the claims, the words 'comprise', 'comprising', and the like, are to be construed in a inclusive as opposed to an exclusive or exhaustive sense; that is to say, in the sense of "including, but not limited to".

The present invention has been described above purely by way of example, and modifications can be made within the spirit of the invention. The invention also consists in any individual features described or implicit herein or shown or implicit in the drawings or any combination of any such features or any generalisation of any such features or combination. In particular, the dimensions and ratios given in the description above are not intended to be limiting, but merely examples of possible construction dimensions. Other dimensions giving a slot drain as claimed may also be used.

The slot drain is described as though it were in its installed orientation, for convenience. However, during for instance manufacture, transport and storage, the orientation of the slot drain can be otherwise, and the invention extends to the slot drain in such other orientations.

What is claimed is:

1. A slot drain comprising:

a throat portion comprising two opposed side walls, at least one side wall having a hole defined therein; and a separator arranged to separate the side walls by abutment of the side walls against opposite sides of the separator, wherein the separator includes at least one upper projection and at least one lower projection provided on at least one side of the separator, at least one of the upper and lower projections is passed through the hole of the at least one side wall and deformed so the at least one of the upper projection and lower projection cannot pass back through the hole without further deformation, and wherein each upper projection provides an upper shoulder against which an upper edge of the hole abuts and each lower projection provides a lower shoulder against which a lower edge of the hole abuts to position the separator vertically with respect to the throat portion, the respective side wall being retained against or adjacent the separator.

2. A slot drain according to claim 1, wherein the at least one side of the separator abuts a corresponding internal face of the side walls for a major part of a height of the side walls.

3. A slot drain according to claim 2, wherein each upper and lower projection comprises a projecting portion projecting away from the separator in a plane of the separator and a retaining portion parallel to the at least one side of the separator.

4. A slot drain according to claim 2, wherein a corresponding one of the upper and lower projection is deformed by being substantially bent about an axis perpendicular to a plane of the side wall adjacent the corresponding one of the upper and lower projection.

5. A slot drain according to claim 2, wherein a corresponding one of the upper and lower projection is deformed by being substantially bent about an axis parallel to a plane of the side wall adjacent the corresponding one of the upper and lower projection.

6. A slot drain according to claim 1, wherein the separator is a flat piece.

7. A slot drain according to claim 1, wherein the lateral projection is integral with the separator.

8. A slot drain according to claim 1, wherein the hole defined in the at least one side wall of the throat portion is adjacent an end of the drain and the corresponding one of the upper and lower projection is bent and projects beyond the end of the drain and adjacent to or touching the throat portion to provide horizontal registration with an end portion of a second slot drain.

9. A slot drain according to claim 1, wherein the separator comprises means for handling the slot drain.

10. A slot drain according to claim 9, wherein the handling means comprises a lateral handling projection on each side of the separator, projecting out through respective holes in the side walls.

11. A slot drain according to claim 1, wherein the separator further comprises means for securing the slot drain in position.

12. A slot drain according to claim 11, wherein the securing means comprises a lateral securing projection disposed intermediate the at lest one upper and lower projection on the at least one side wall of the separator, the lateral securing projection projecting out through a corresponding hole defined in the throat portion for connection to an external securing member.

13. A slot drain according to claim 12, wherein the securing means comprise a hook on the securing projection.

14. A slot drain according to claim 1, further comprising two parts, each part forming half the throat portion and half a channel portion arranged to carry drainage water therethrough, the two parts being joined at a base of the channel portion.

15. A slot drain according to claim 14, wherein the two parts are nested before assembly.

16. A slot drain according to claim 15, wherein the two parts are identical.

17. A slot drain according to claim 1, wherein the separator comprises a slot arranged to receive a plate which extends generally parallel to the side walls, wherein the plate divides a top open end of the throat portion in two longitudinally.

18. A slot drain according to claim 1, wherein a channel is defined below the throat portion, and comprising two parts, each part providing a corresponding side wall of the throat portion and one side of the channel, said each part also providing a horizontal flange, wherein the horizontal flanges project in opposite directions at a bottom of the channel, for resting on a surface and supporting the slot drain.

19. The slot drain of claim 18, wherein said each part provides a vertical flange along the bottom, the horizontal flanges terminating the vertical flange.

20. A kit of parts for a slot drain as claimed in claim 1.

21. A drainage system comprising a plurality of slot drains according to claim 1, connected end to end.

22. A road or runway comprising a drainage system according to claim 21.

23. A method of constructing a slot drain having a throat portion comprising two walls and a separator separating the walls from each other to provide a slot, the separator having at least one upper and lower projection provided on at least one side of the separator and the respective wall having a hole through which at least one of the upper and lower projections can pass, wherein each upper projection provides an upper shoulder against which an upper edge of the hole abuts and each lower projection provides a lower shoulder against which a lower edge of the hole abuts to locate the separator vertically with respect to the throat portion, comprising:

passing a corresponding one of the plurality of upper and lower projections of the separator through the hole; and retaining the respective wall against or adjacent the separator by deformation of the corresponding one of the plurality of upper and lower projections wherein the corresponding one of the plurality of upper and lower projections cannot pass back through the hole without further deformation.

24. The method of claim 23, wherein a number of slot drains are manufactured each primarily in the form of two parts, each part providing a side wall of the throat portion and one side of a channel below the throat portion, and wherein the parts are provided disassembled with said parts nested, and later assembled.

25. The method of claim 23, wherein each of said two parts is identical to the other.

26. The method of claim 23, wherein the corresponding one of the plurality of upper and lower projections is mechanically deformed by hand or using a tool.

27. The method of claim 23, wherein the slot drains are manufactured each primarily in the form of two parts, each part providing a side wall of the throat portion and one side of a channel below the throat portion, each part also providing a vertical flange along the bottom, the slot drains being assembled by retaining the throat side walls against or adjacent the separator, and by mechanically fixing together opposing flanges on the bottom of the channel.

28. A slot drain comprising:

a throat portion comprising two opposed side walls, at least one of which has a hole defined therein; and a separator arranged to separate the side walls by abutment of the walls against opposite sides of the separator, the separator having upper and lower lateral projections which pass through the hole of the at least one side wall and are deformed in such a way that each lateral projection cannot pass back through the hole without further deformation, the respective wall being thereby retained against or adjacent the separator; and defining a channel below said throat portion, and comprising two parts, each part providing one of said side walls of the throat portion and one side of the channel, said each part also providing a horizontal flange, wherein the horizontal flanges project in opposite directions at the bottom of the channel, for resting on a surface and supporting the slot drain.

29. A slot drain comprising:

a throat portion comprising two opposed side walls, at least one of which has a hole defined therein; and a separator arranged to separate the side walls by abutment of the walls against opposite sides of the separator, the separator having upper and lower lateral projections which pass through the hole of the at least one side wall and are deformed in such a way that each lateral projection cannot pass back through the hole without further deformation, the respective wall being thereby retained against or adjacent the separator; and defining a channel below said throat portion, and comprising two parts, each part providing one of said side walls of the throat portion and one side of the channel, said each part also providing a horizontal flange, wherein the horizontal flanges project in opposite directions at the bottom of the channel, for resting on a surface and supporting the slot drain, wherein said each part provides a vertical flange along the bottom, the horizontal flange terminating the vertical flange.

30. A slot drain comprising:

a throat portion comprising two opposed side walls, at least one of which has a hole defined therein; and a separator arranged to separate the side walls by abutment of the walls against opposite sides of the separator, the separator having upper and lower lateral projections which pass through the hole of the at least one side wall and are deformed in such a way that each lateral projection cannot pass back through the hole without further deformation, the respective wall being thereby retained against or adjacent the separator, wherein the sides of the separator abut the internal faces of the walls for a major part of the height of the walls.

* * * * *